US011035643B2

(12) United States Patent
Maeda

(10) Patent No.: US 11,035,643 B2
(45) Date of Patent: Jun. 15, 2021

(54) TOY GUN

(71) Applicant: MARUZEN COMPANY LIMITED, Tokyo (JP)

(72) Inventor: Tetsuo Maeda, Tokyo (JP)

(73) Assignee: MARUZEN COMPANY LIMITED, Tokyo (JP)

( * ) Notice: Subject to any disclaimer, the term of this patent is extended or adjusted under 35 U.S.C. 154(b) by 0 days.

(21) Appl. No.: 16/728,830

(22) Filed: Dec. 27, 2019

(65) Prior Publication Data

US 2020/0208941 A1 Jul. 2, 2020

(30) Foreign Application Priority Data

Dec. 28, 2018 (JP) ..... JP2018-248134

(51) Int. Cl.

| | |
|---|---|
| ***F41B 7/08*** | (2006.01) |
| ***F41B 11/70*** | (2013.01) |
| ***F41B 11/80*** | (2013.01) |
| ***F41B 7/00*** | (2006.01) |

(52) U.S. Cl.

CPC ..... *F41B 11/70* (2013.01); *F41B 7/003* (2013.01); *F41B 7/08* (2013.01); *F41B 11/80* (2013.01)

(58) Field of Classification Search

CPC ..... F41B 7/003; F41B 7/08; F41B 11/00
See application file for complete search history.

(56) References Cited

U.S. PATENT DOCUMENTS 2,455,608 A 12/1948 Rosengren
5,205,271 A * 4/1993 Casas Salva ..... F41B 11/00 124/65
6,606,812 B1 8/2003 Gwinn, Jr.
(Continued)

FOREIGN PATENT DOCUMENTS

GB 586495 A 3/1947
TW M522335 U 5/2016
(Continued)

OTHER PUBLICATIONS

The extended European search report mailed in European Patent Application No. 19219588.1, dated May 28, 2020.
(Continued)

*Primary Examiner* — John A Ricci
(74) *Attorney, Agent, or Firm* — Michael Best & Friedrich LLP

(57) ABSTRACT

A barrel catch of a toy gun has a barrel through hole with diameter larger than outer circumference of the barrel so that the barrel penetrates through hole center. The barrel catch includes a barrel fitting portion fitted/attached to the barrel on the inner circumference of the hole opposite to the pressing portion exposed from an opening in a barrel attachment portion of a toy gun body. The barrel catch is housed in a housing portion of the toy gun body slidably in the direction defined by the pressing portion and the opposite portion of the pressing portion. The barrel includes a barrel catch fitting portion fittable to the barrel fitting portion of the barrel catch upon penetration of the barrel through the barrel catch. The barrel slidably penetrates the barrel through hole of the barrel catch in the direction defined by the pressing portion and the opposite portion.

7 Claims, 7 Drawing Sheets

(56) References Cited

U.S. PATENT DOCUMENTS

| | | | | |
|---|---|---|---|---|
| 6,698,128 | B2 * | 3/2004 | Kessler | F41A 21/00 124/83 |
| 7,076,905 | B2 * | 7/2006 | Zouboulakis | F41A 11/02 124/83 |
| 7,691,759 | B2 * | 4/2010 | Perry | F41B 11/00 442/77 |
| 7,775,200 | B2 * | 8/2010 | Anderson | F41A 21/02 124/83 |
| 10,436,533 | B2 * | 10/2019 | Ferguson | F41C 23/16 |
| 2017/0184368 | A1 | 6/2017 | Cheng | |
| 2019/0113297 | A1 | 4/2019 | Turlakov | |

FOREIGN PATENT DOCUMENTS

| | | | |
|---|---|---|---|
| WO | 2013/014656 | A1 | 5/2016 |
| WO | 2017/167924 | A1 | 5/2017 |

OTHER PUBLICATIONS

Search Report issued in Taiwanese Application No. 108147612, dated Aug. 17, 2020.

* cited by examiner

TOY GUN

CROSS REFERENCE TO RELATED APPLICATION

The present application is based on and claims the benefit of priority of Japanese Patent Application No. 2018-248134 filed on Dec. 28, 2018, the entire contents of which is incorporated herein by reference.

TECHNICAL FIELD

The present invention relates to a toy gun, specifically to an air gun. More specifically, the present invention relates to an air gun, a barrel used for the air gun, and a barrel catch to be attached to the air gun.

BACKGROUND ART

The toy gun is very likely to have barrel clogged with a bullet owing to the bullet molding failure.

In the general case, when the bullet is caught in the barrel, a stick-like member is inserted from the muzzle to remove the clogging bullet for resumption of the use. There may be the case that gas within the gas chamber is discharged owing to the failure resulting from removal of the clogging bullet.

For the purpose of avoiding the above-described problem, the toy gun is required to allow the user to easily remove the barrel unit from the toy gun body to perform the maintenance of the barrel by itself separately.

Unlike the present invention, Japanese Unexamined Patent Application Publication No. Hei 6 (1994)-123594 titled "Electric toy gun and bullet support member used for the electric toy gun" aims at "providing the bullet support member that prevents the bullet from clogging halfway, and from falling down."

Meanwhile, the barrel of the generally employed toy gun is rigidly attached to the mechanical frame of the toy gun body. It is known that the extended inner barrel may accelerate the bullet speed. However, it is not easy to replace the barrel. In the above-described circumstances, the toy gun that is different only in the barrel length has to be distributed as the toy gun of different model.

As an accessory of the generally employed toy gun, a silencer has been known. The real gun has a silencer serving as the noise eliminator. Meanwhile, the toy gun includes a fake silencer. The outer barrel of the toy gun has to be threaded for attachment of the fake silencer. This may deteriorate the appearance of the toy gun, and cause the joint part between the barrel and the silencer to have insufficient strength.

SUMMARY OF THE INVENTION

It is an object of the present invention to allow easy replacement of the barrel of the toy gun.

The present invention provides a toy gun comprising:

a toy gun body, a barrel, and a barrel catch, wherein the toy gun body includes a barrel attachment portion for attaching the barrel, the barrel attachment portion including a barrel catch housing portion for housing the barrel catch, the surface of the barrel catch housing portion having an opening from which a pressing portion as a part of the barrel catch is exposed, wherein the barrel catch includes: a barrel through hole with a diameter larger than that of an outer circumference of the barrel, the barrel through hole allowing penetration of the barrel through its center; and a barrel fitting portion to which the barrel is fitted and attached on an inner circumference of a hole as an opposite portion of the pressing portion exposed from the opening, the barrel catch being housed in the barrel catch housing portion slidably in a direction defined by the pressing portion and the opposite portion of the pressing portion, wherein the barrel includes a barrel catch fitting portion fittable to the barrel fitting portion of the barrel catch when penetrating the barrel through the barrel catch, and wherein the barrel slidably penetrates the barrel through hole of the barrel catch in the direction defined by the pressing portion and the opposite portion of the pressing portion of the barrel catch.

The present invention further provides the toy gun, wherein the barrel fitting portion of the barrel catch has a curved convex cross section, and the barrel catch fitting portion of the barrel has a curved concave cross section that is fittable to the convex shape of the barrel fitting portion.

The present invention further provides the toy gun, wherein the barrel catch slidingly moves, and pressing the pressing portion to the barrel allows to release a fitting state between the barrel catch fitting portion of the barrel and the barrel fitting portion of the barrel catch, and stopping pressing of the pressing portion to the barrel allows fitting between the barrel fitting portion and the barrel catch fitting portion to fix the barrel to the barrel catch.

The present invention further provides the toy gun, wherein the barrel is an outer barrel.

The present invention further provides the toy gun, wherein the barrel through hole has a diameter larger than that of the outer circumference of the barrel in the direction defined by the pressing portion and the opposite portion.

The present invention further provides the toy gun, wherein the barrel attachment portion includes a barrel catch housing portion for housing the barrel catch, having a diameter larger than that of the outer circumference of the barrel catch in the direction defined by the pressing portion and the opposite portion.

The present invention further provides the toy gun, wherein the barrel catch has flexibility.

The present invention provides a barrel catch through which a barrel is allowed to penetrate, and housed in a toy gun body, wherein the toy gun body includes a barrel attachment portion for attaching the barrel, the barrel attachment portion including a barrel catch housing portion for housing the barrel catch, the surface of the barrel catch housing portion having an opening from which a pressing portion as a part of the barrel catch is exposed, wherein the barrel catch includes: a barrel through hole with a diameter larger than that of an outer circumference of the barrel, the barrel through hole allowing penetration of the barrel through its center; and a barrel fitting portion to which the barrel is fitted and attached on an inner circumference of a hole as an opposite portion of the pressing portion exposed from the opening, the barrel catch being housed in the barrel catch housing portion slidably in a direction defined by the pressing portion and the opposite portion of the pressing portion, wherein the barrel includes a barrel catch fitting portion fittable to the barrel fitting portion of the barrel catch when penetrating the barrel through the barrel catch, and wherein the barrel slidably penetrates the barrel through hole of the barrel catch in the direction defined by the pressing portion and the opposite portion of the pressing portion of the barrel catch.

The present invention further provides the barrel catch, wherein the barrel fitting portion of the barrel catch has a curved convex cross section, and wherein the barrel catch fitting portion of the barrel has a curved concave cross section that is fittable to the convex shape of the barrel fitting portion.

The present invention further provides the barrel catch, wherein the barrel catch slidingly moves, and pressing the pressing portion to the barrel allows release a fitting state between the barrel catch fitting portion of the barrel and the barrel fitting portion of the barrel catch, and stopping pressing of the pressing portion to the barrel allows fitting between the barrel fitting portion and the barrel catch fitting portion to fix the barrel to the barrel catch.

The present invention further provides the barrel catch, wherein the barrel is an outer barrel.

The present invention further provides the barrel catch, wherein the barrel through hole has a diameter larger than that of the outer circumference of the barrel in the direction defined by the pressing portion and the opposite portion.

The present invention further provides the barrel catch, wherein the barrel attachment portion includes a barrel catch housing portion for housing the barrel catch, having a diameter larger than that of the outer circumference of the barrel catch in the direction defined by the pressing portion and the opposite portion.

The present invention further provides the barrel catch, wherein the barrel catch has flexibility.

The present invention further provides a barrel which penetrates through a barrel catch to be housed in a toy gun body, wherein the toy gun body includes a barrel attachment portion for attaching the barrel, the barrel attachment portion including a barrel catch housing portion for housing the barrel catch, the surface of the barrel catch housing portion having an opening from which a pressing portion as a part of the barrel catch is exposed, wherein the barrel catch includes: a barrel through hole with a diameter larger than that of an outer circumference of the barrel, the barrel through hole allowing penetration of the barrel through its center; and a barrel fitting portion to which the barrel is fitted and attached on an inner circumference of a hole as an opposite portion of the pressing portion exposed from the opening, the barrel catch being housed in the barrel catch housing portion slidably in a direction defined by the pressing portion and the opposite portion of the pressing portion, wherein the barrel includes a barrel catch fitting portion fittable to the barrel fitting portion of the barrel catch when penetrating the barrel through the barrel catch, and wherein the barrel slidably penetrates the barrel through hole of the barrel catch in the direction defined by the pressing portion and the opposite portion of the pressing portion of the barrel catch.

The present invention further provides the barrel, wherein the barrel fitting portion of the barrel catch has a curved convex cross section, and the barrel catch fitting portion of the barrel has a curved concave cross section that is fittable to the convex shape of the barrel fitting portion.

The present invention further provides the barrel, wherein the barrel catch slidingly moves, and pressing the pressing portion to the barrel allows release a fitting state between the barrel catch fitting portion of the barrel and the barrel fitting portion of the barrel catch, stopping pressing of the pressing portion to the barrel allows fitting between the barrel fitting portion and the barrel catch fitting portion to fix the barrel to the barrel catch.

The present invention further provides the barrel, wherein the barrel is an outer barrel.

The present invention further provides the barrel, wherein the barrel through hole has a diameter larger than that of the outer circumference of the barrel in the direction defined by the pressing portion and the opposite portion.

The present invention further provides the barrel, wherein the barrel attachment portion includes a barrel catch housing portion for housing the barrel catch, having a diameter larger than that of the outer circumference of the barrel catch in the direction defined by the pressing portion and the opposite portion.

The present invention further provides the barrel, wherein the barrel catch has flexibility.

As the pressing portion is pressed to the barrel, the barrel catch slidingly moves to release the fitting state between the barrel catch fitting portion of the barrel and the barrel fitting portion of the barrel catch. As a result, fixation between the barrel and the barrel catch is released.

As pressing of the pressing portion to the barrel is stopped, the barrel fitting portion is fitted to the barrel catch fitting portion to fix the barrel to the barrel catch.

According to the present invention, the barrel replacement may be easily performed, allowing the use of the long barrel, and the barrel unit with strength sufficient to carry the silencer. Furthermore, it is possible to diversify the product variation.

In the present invention, the barrel fitting portion formed on the barrel catch to be used for attaching the barrel to the toy gun has a curved convex cross section. Forming the barrel catch fitting portion of the barrel to have the curved concave cross section that is fittable to the convex shape of the barrel fitting portion allows the respective curved cross sections to be fitted. This makes it possible to attach the barrel fitting portion to the barrel catch fitting portion. As a result, a fitting member for fitting the barrel fitting portion to the barrel catch fitting portion is not necessary in addition to the barrel catch.

The barrel fitting portion and the barrel catch fitting portion have their substantially curved cross sections fitted for attachment by engagement between them, resulting in smooth fitting.

DETAILED DESCRIPTION OF EMBODIMENTS

Figure 1:
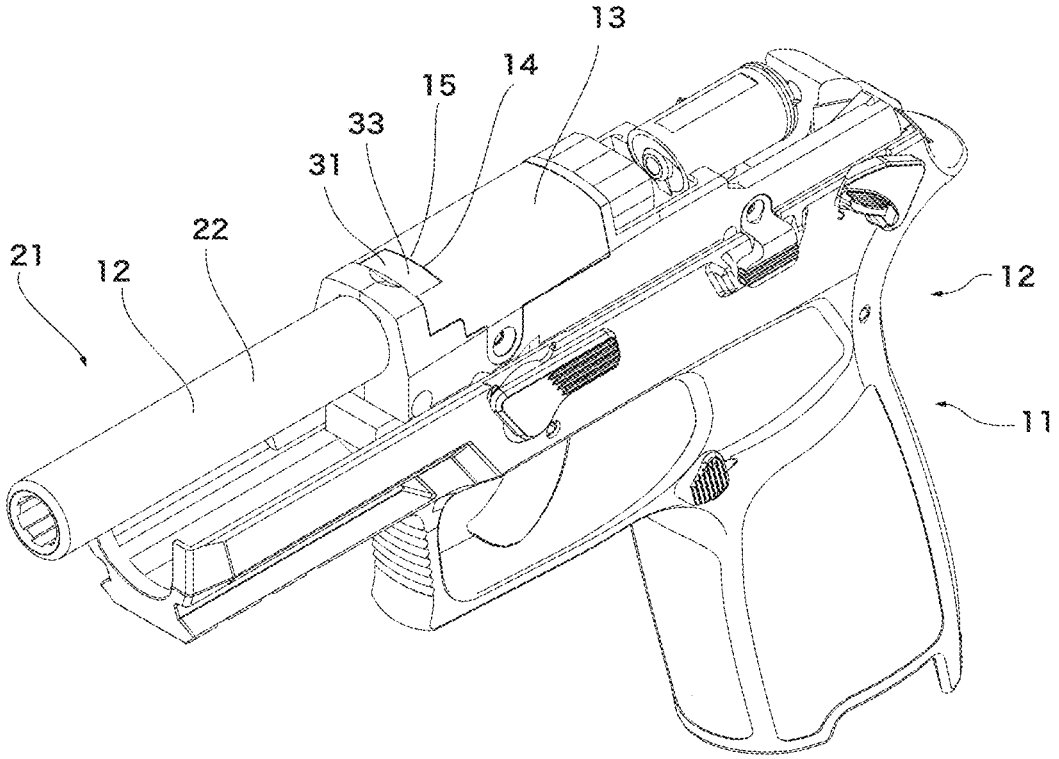
FIG. 1 is a perspective view of a toy gun as an example of an embodiment according to the present invention in a state that a slide that covers the upper part of the toy gun including a barrel is pulled out, and the inside of the upper part is exposed.
Figure 2:
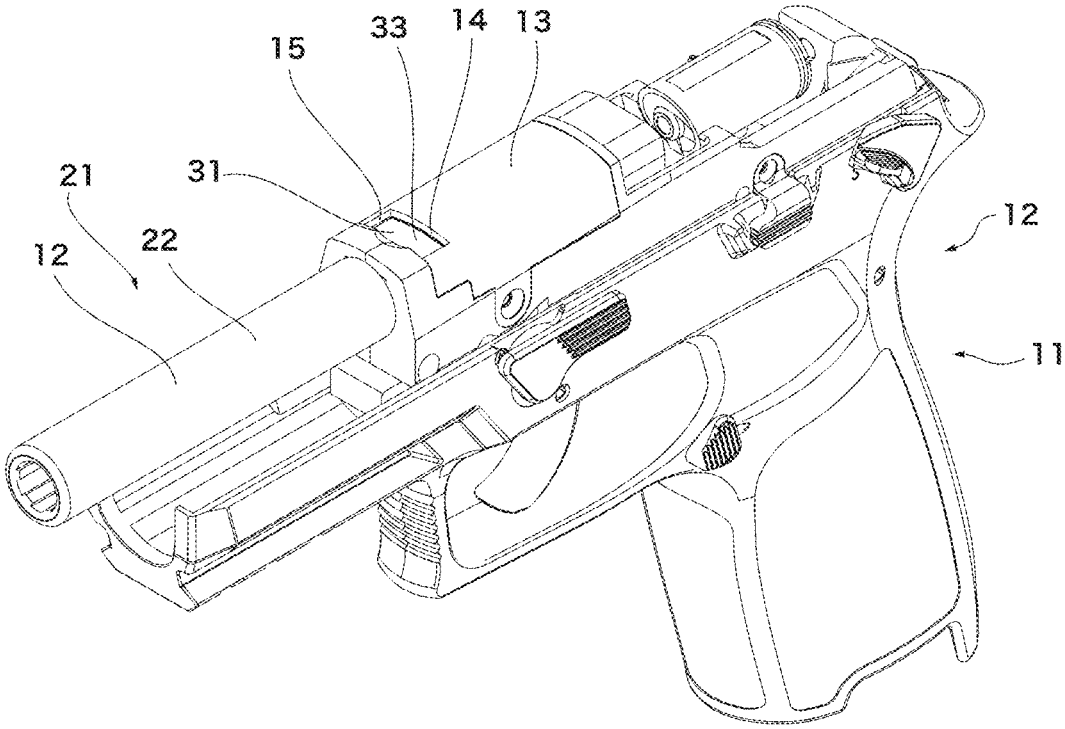
FIG. 2 is a perspective view of the toy gun as the example of the embodiment according to the present invention in a state that the slide that covers the upper part of the toy gun including the barrel is pulled out, the barrel catch (outer barrel catch) is pushed down, and the inside of the upper part is exposed.

An example of an embodiment according to the present invention will be described referring to the drawings.

A toy gun 11 includes a toy gun body 12, a barrel 21, and a barrel catch 31 as an outer barrel catch.

The barrel 21 includes a cylindrical outer barrel 22 constituting an outer side of the barrel 21, and a cylindrical inner barrel 23 constituting an inner side of the barrel 21. A bullet to be fired from the toy gun 11 passes through the inner barrel 23.

As shown in FIGS. 11 to 15, the inner barrel 23 of the barrel 21 is attached inside the outer barrel 22 via a spring 25. The spring 25 biases the inner barrel 23 to the rear end side of the toy gun 11.

As shown in FIGS. 3, 4, 15, 16 and the like, the barrel 21 includes a barrel catch fitting portion 24 on a halfway position of the shaft. The barrel catch fitting portion 24 constitutes a concave cross section portion of a lower half shaft part of the barrel 21 as a belt-like inwardly concave shape from the surface. The barrel catch fitting portion 24 has the curved concave cross section. The width of the lower half shaft part of the barrel 21 serves as a fitting portion.

The barrel catch fitting portion 24 is formed in the barrel 21 at a portion in abutment with the barrel fitting portion 34 as the outer barrel fitting portion formed in the barrel catch 31 upon insertion of the barrel 21 through the barrel catch 31. The barrel catch fitting portion 24 is inwardly concave with the curved concave cross section. Therefore, the barrel catch fitting portion 24 may be fitted with the barrel fitting portion 34 with the substantially curved cross section.

The barrel 21 penetrates through a barrel through hole 32 formed in the barrel catch 31 as the outer barrel catch. The barrel through hole 32 has its diameter larger than that of the outer circumference of the barrel 21 in the direction defined by the pressing portion 33 and a opposite portion of the pressing portion 33. The barrel 21 is slidable through the barrel catch in the direction defined by the pressing portion 33 and the opposite portion 33. The barrel 21 and the barrel catch 31 may be configured to mutually slide in the direction defined by the pressing portion 33 and the opposite portion 33.

A reference numeral 26 denotes a chamber. The chamber 26 is a member for holding a bullet prior to firing. The chamber 26 is fitted to the outer barrel 22 at a rear end of the toy gun.

The barrel unit is constituted by the outer barrel 22, the inner barrel 23, the spring 25, the chamber 26, and the like.

Figure 15:
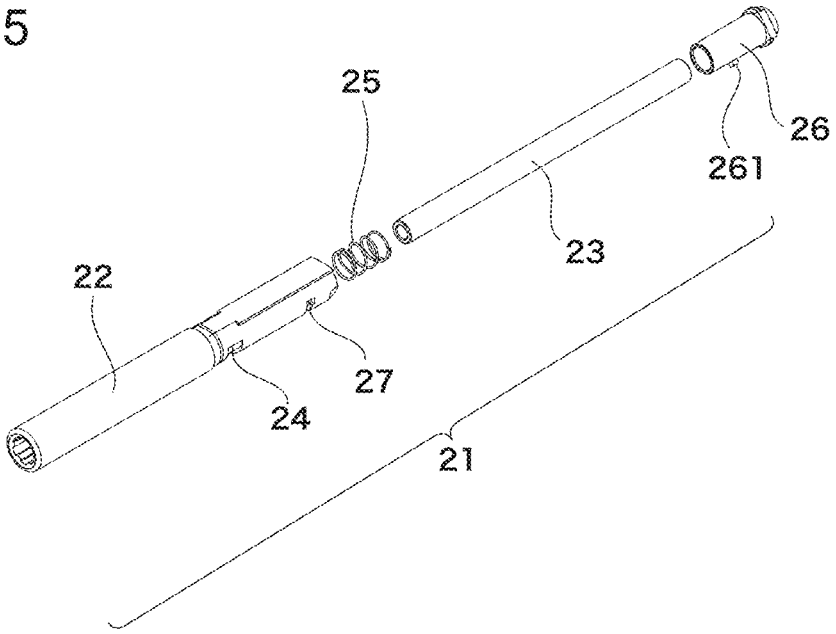
FIG. 15 is an exploded perspective view of the barrel (outer barrel) of the toy gun as the example of the embodiment according to the present invention.

A reference numeral 261 denotes a chamber convex portion. As shown in FIG. 15, the chamber convex portion 261 is formed on a side part of the chamber 26 to be engaged with a notch 27 formed in the rear side of the muzzle of the outer barrel 22 of the barrel unit.

Figure 11:
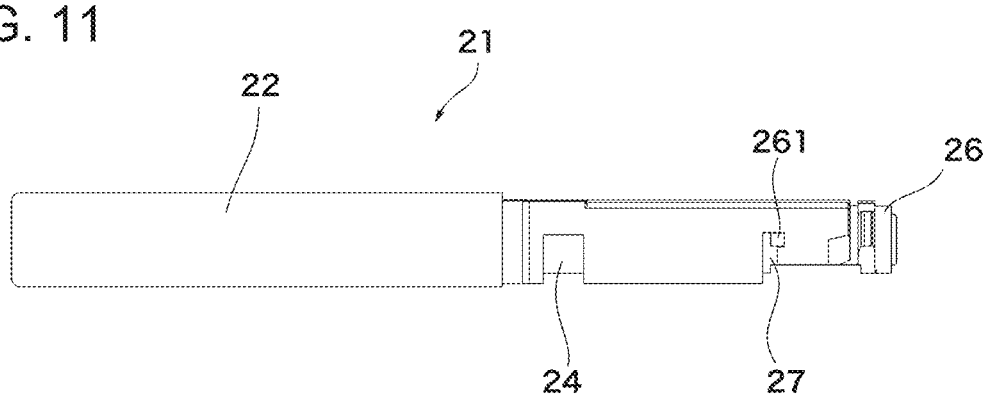
FIG. 11 is a front view of the barrel (outer barrel) of the toy gun as the example of the embodiment according to the present invention.
Figure 12:
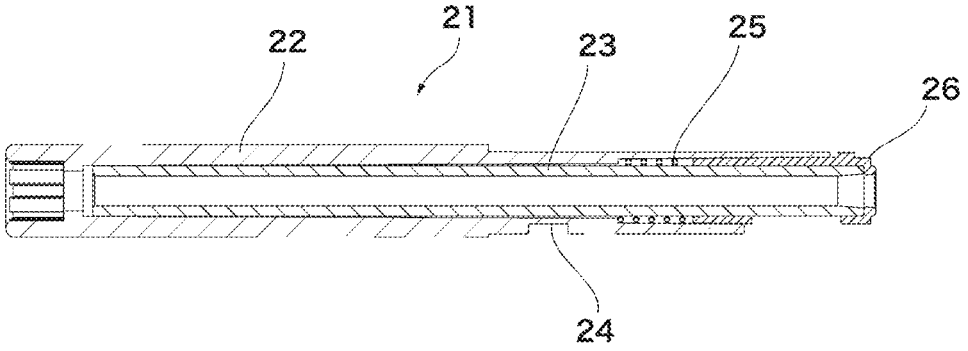
FIG. 12 is a sectional view of a center part of the barrel (outer barrel) of the toy gun as the example of the embodiment according to the present invention.

FIG. 11 is a side view of the barrel unit, and FIG. 12 is a sectional side view of the barrel unit. The chamber 26 is inserted into the barrel 21 constituted by the outer barrel 22 and the inner barrel 23.

Figure 13:
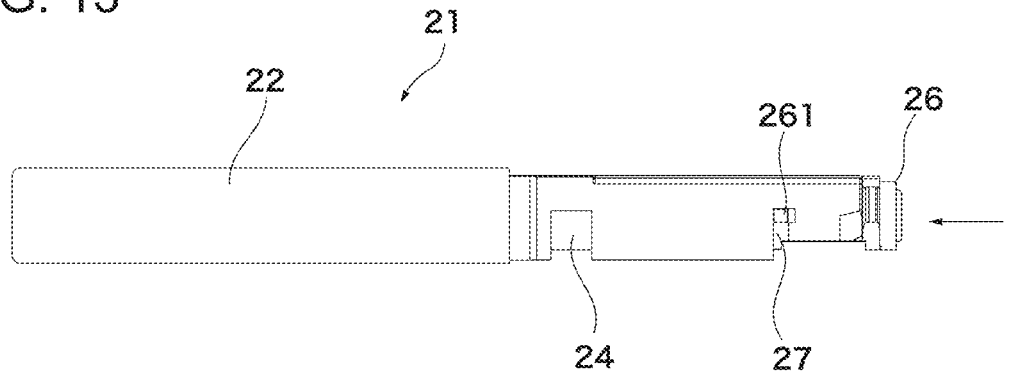
FIG. 13 is a front view of the barrel (outer barrel) of the toy gun as the example of the embodiment according to the present invention.
Figure 14:
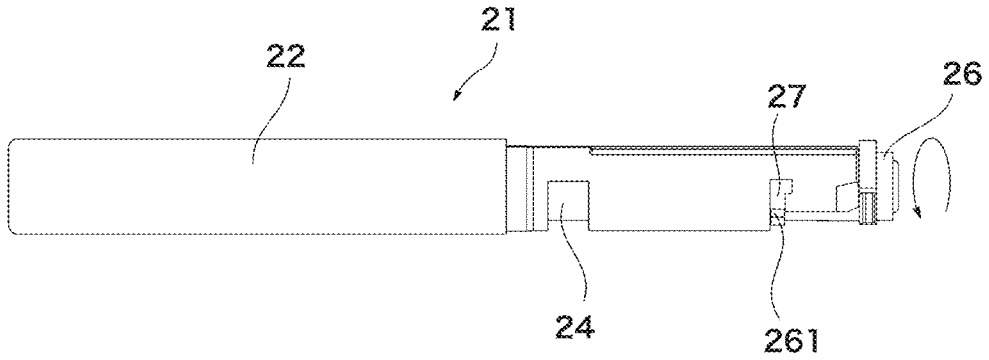
FIG. 14 is a front view of the barrel (outer barrel) of the toy gun as the example of the embodiment according to the present invention.

FIG. 13 represents the state where the chamber convex portion 261 of the chamber 26 inserted into the barrel 21 is disengaged from the notch 27 of the outer barrel 22 in transition from the state as shown in FIG. 11 and FIG. 12. FIG. 14 represents the state where the chamber 26 is turned counterclockwise when seen from the operator in transition from the state as shown in FIG. 13. The chamber 26 then is ready for disengagement from the barrel unit.

The chamber 26 is inserted into the outer barrel 22 of the barrel unit by turning the chamber convex portion 261, and hooked on the notch 27 of the outer barrel 22. The chamber 26 is fixed to the outer barrel 22.

Figure 3:
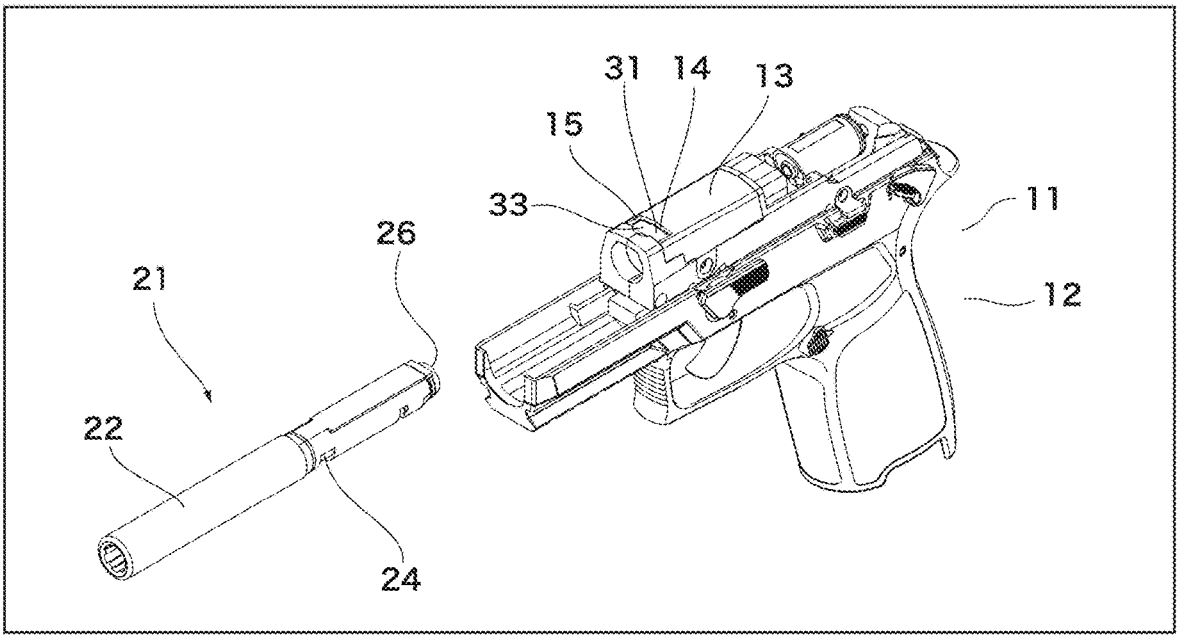
FIG. 3 is a perspective view of the toy gun as the example of the embodiment according to the present invention in a state that the slide that covers the upper part of the toy gun including the barrel, and the barrel (outer barrel) are pulled out, the barrel catch (outer barrel catch) is pushed down, and the inside of the upper part is exposed.
Figure 4:
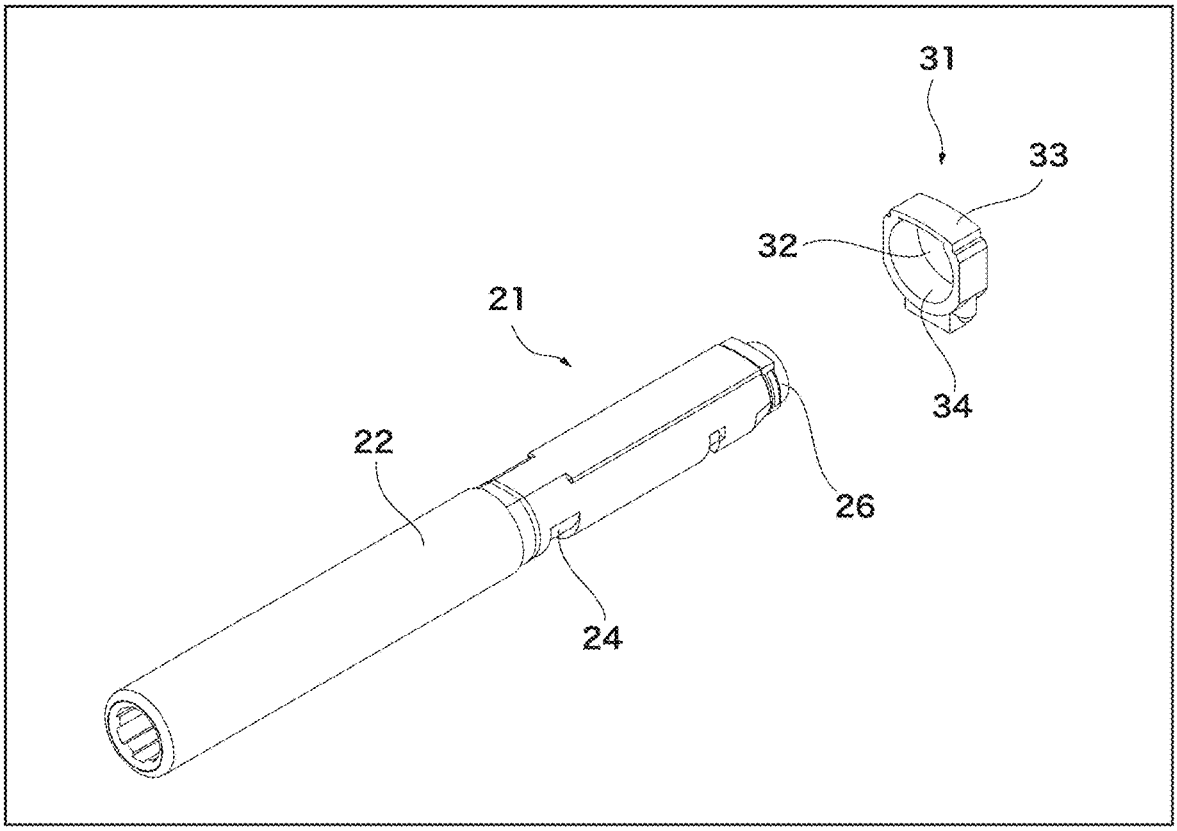
FIG. 4 is a perspective view of the barrel (outer barrel) and the barrel catch (outer barrel catch) of the toy gun as the example of the embodiment according to the present invention before they are assembled.
Figure 5:
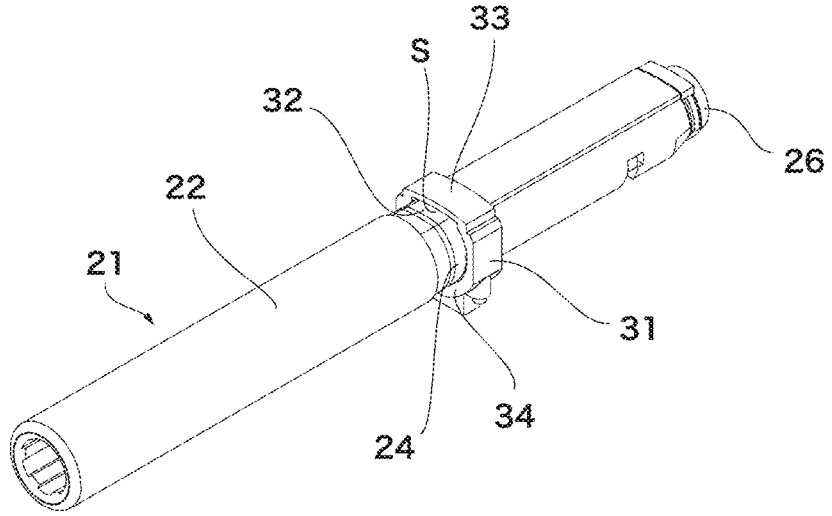
FIG. 5 is a perspective view showing the state that the barrel (outer barrel) and the barrel catch (outer barrel catch) of the toy gun as the example of the embodiment according to the present invention are fitted to each other.
Figure 6:
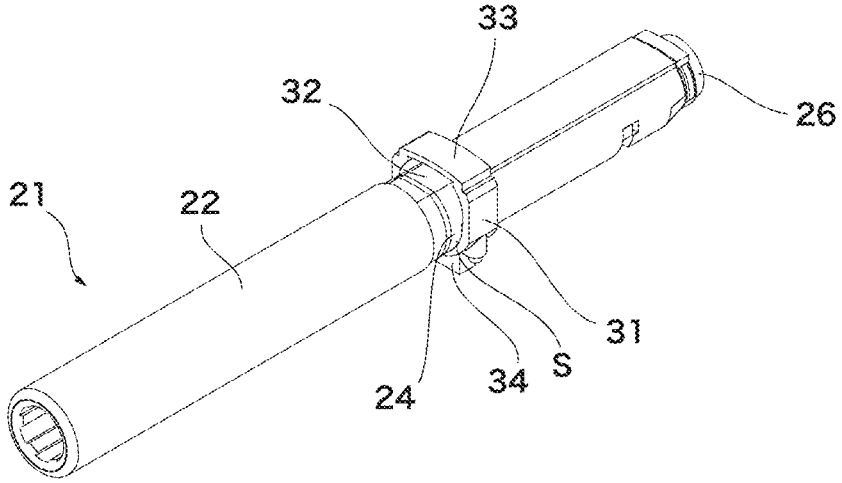
FIG. 6 is a perspective view showing the state that the fitting state between the barrel (outer barrel) and the barrel catch (outer barrel catch) of the toy gun as the example of the embodiment according to the present invention is released.
Figure 7:
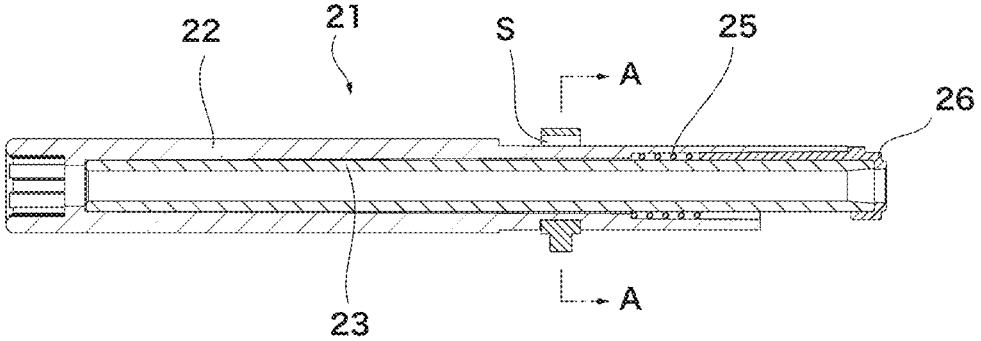
FIG. 7 is a sectional view of a center part of a structure in which the barrel (outer barrel) and the barrel catch (outer barrel catch) of the toy gun as the example of the embodiment according to the present invention are fitted to each other.

A reference numeral 13 denotes a barrel attachment portion. A barrel attachment portion 13 is formed horizontally at the rear part of the barrel 21 attached onto the upper part of the toy gun body 12. As FIG. 3 shows, a base portion of the barrel 21 is horizontally inserted into the barrel attachment portion 13, and fixed thereto.

A reference numeral 14 denotes a barrel catch housing portion. The barrel catch housing portion 14 is formed into a hole or a concave portion in the barrel attachment portion 13. The barrel catch 31 is housed in the barrel catch housing portion 14.

An opening 15 through which the pressing portion 33 as a part of the barrel catch is exposed is formed in the surface of the barrel catch housing portion 14 of the barrel attachment portion 13.

The barrel catch 31 as the outer barrel catch has a wide ring-like shape having a curved cross section, and has the barrel through hole 32 with diameter larger than that of the outer circumference of the barrel 21 at the center.

The barrel 21 is inserted to penetrate through the center of the barrel catch 31, and attached. The barrel 21 is attached to the toy gun body 12 together with the barrel catch 31.

A reference numeral 33 denotes a pressing portion 33. The pressing portion 33 partially constitutes the outer circumference of the ring-like barrel catch 31.

A reference numeral 34 denotes a barrel fitting portion as the outer barrel fitting portion. The barrel fitting portion 34 has a shape fittable to the barrel catch fitting portion 24 of the barrel 21. In this example, the barrel fitting portion 34 has a belt-like convex portion with a width of the inner diameter of the barrel catch 31, substantially the same width as that of the barrel catch fitting portion 24, and has a curved cross section. The barrel fitting portion 34 is formed on almost entire circumference of the inner diameter of the barrel catch 31 including the inner circumference of the hole as an opposite portion of the pressing portion 33. The width of the barrel catch 31 by itself serves as the barrel fitting portion 34.

The barrel catch fitting portion 24 of the barrel 21 is fitted to the barrel fitting portion 34 by engagement between the respective portions each with the substantially curved cross section on the inner circumference of the hole as the opposite portion of the pressing portion 33.

The barrel catch 31 is housed in the barrel catch housing portion 14 slidably in a direction defined by the pressing portion 33 and the opposite portion.

Figure 8:
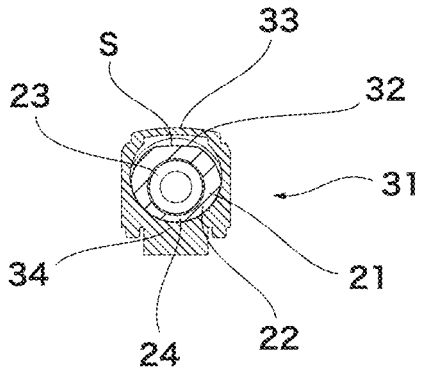
FIG. 8 is a sectional view taken along line A-A of FIG. 7 of the toy gun as the example of the embodiment according to the present invention.
Figure 9:
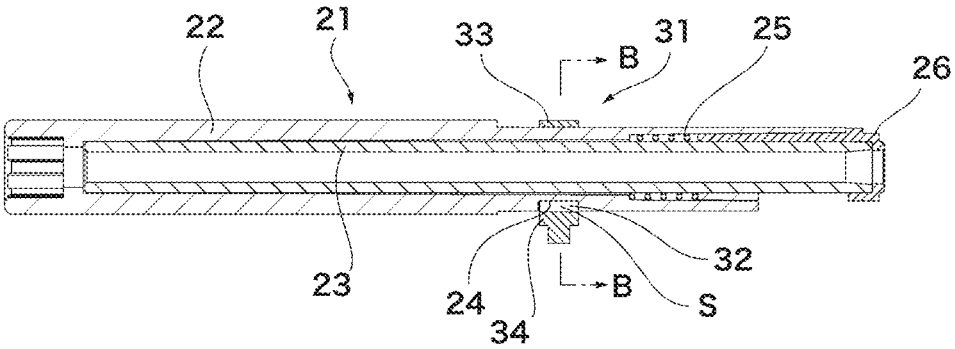
FIG. 9 is a sectional view of a center part of the structure in which the barrel (outer barrel) and the barrel catch (outer barrel catch) of the toy gun as the example of the embodiment according to the present invention are released from the fitted state.
Figure 10:
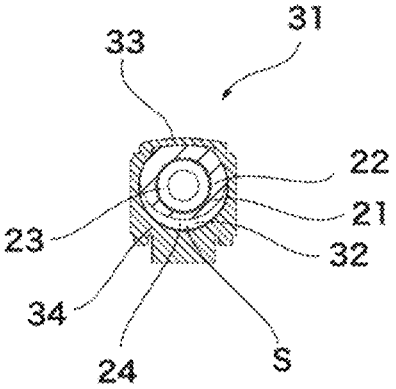
FIG. 10 is a sectional view taken along line B-B of FIG. 9 of the toy gun as the example of the embodiment according to the present invention.

As shown in FIGS. 8 and 10, the barrel through hole 32 has a diameter larger than that of the outer circumference of the barrel 21 in the direction defined by the pressing portion 33 and the opposite portion 33. The barrel 21 is slidable in the direction defined by the pressing portion 33 of the barrel catch 31, and the opposite portion. When the barrel 21 is inserted to penetrate through the barrel through hole 32, a space S is formed below the pressing portion 33. The barrel catch housing portion 14 has a diameter larger than that of the outer circumference of the barrel catch 31 in the direction defined by the pressing portion 33 and the opposite portion. The barrel catch 31 is slidable in the barrel catch housing portion 14 in the direction defined by the pressing portion 33 and the opposite portion.

The barrel catch 31 as the outer barrel catch has flexibility.

The pressing portion 33 is exposed from the opening 15 in the surface of the barrel catch housing portion 14.

Referring to FIGS. 2, 3, and 5 to 10, as the pressing portion 33 is pressed down to the barrel 21, the barrel catch 31 as the outer barrel catch slidingly moves from the state as shown in FIGS. 1, 5, 7, 8 to the state as shown in FIGS. 2, 6, 9, 10. The space S is then generated below the barrel 21 at the opposite portion of the pressing portion 33. Accordingly, the barrel catch fitting portion 24 of the barrel 21 is disengaged from the barrel fitting portion 34 of the barrel catch 31.

By disengaging the barrel catch fitting 24 of the barrel 21 from the barrel fitting portion 34 of the barrel catch 31, fixation between the barrel 21 and the barrel catch 31 is released.

As the fixation between the barrel 21 and the barrel catch 31 is released, the barrel 21 may be removed from the barrel attachment portion 13 of the toy gun body 12.

By fitting the barrel fitting portion 34 to the barrel catch fitting portion 24 without pressing down the pressing portion 33 to the barrel 21, the barrel 21 is fixed to the barrel catch 31. At this time, the space S is formed below the pressing portion 33.

This makes it possible to insert the barrel 21 into the barrel attachment portion 13 so as to be fixed to the toy gun body 12.

In this embodiment, the barrel fitting portion 34 of the barrel catch 31 for attaching the barrel 21 to the toy gun body 12 has the belt-like shape with a width of the inner diameter of the barrel catch 31, and has the curved convex cross section. The barrel catch fitting portion 24 of the barrel 21 is formed to have the curved concave cross section fittable to the convex portion of the barrel fitting portion 34. Therefore, the barrel fitting portion 34 may be attached to the barrel catch fitting portion 24 by engagement between the respective portions each with substantially curved cross section. That is, each width of the barrel 21 and the barrel catch 31 serves as the fitting portion. Accordingly, besides the barrel catch 31, an additional member for fitting the barrel fitting portion 34 to the barrel catch fitting portion 24 is not necessary.

Figure 16:
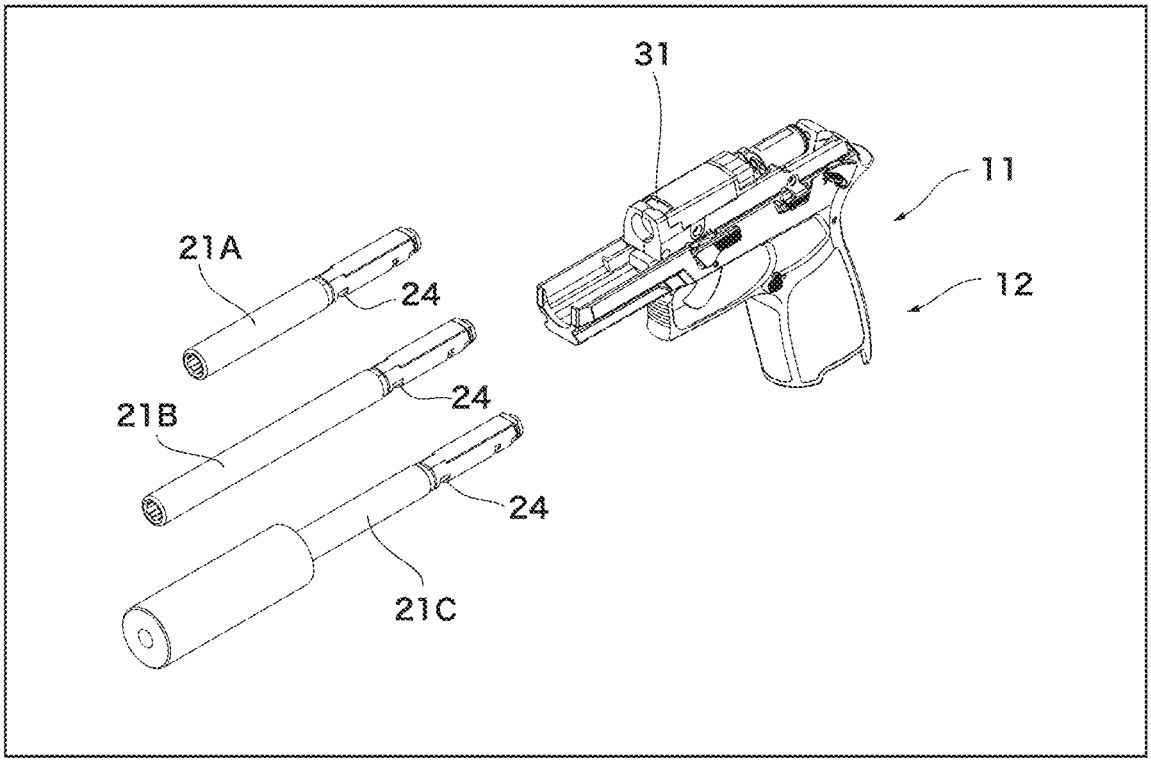
FIG. 16 is an assembly perspective view of the toy gun as an example of the embodiment according to the present invention.

The barrel 21 can be easily removed from the toy gun body 12. As shown in FIG. 16, the barrel 21 may be replaced with various types of barrel units such as a short barrel unit 21A, a long barrel unit 21B, and a further longer barrel unit 21C carrying the fake silencer.

Furthermore, the barrel fitting portion is attached to the barrel catch fitting portion by engagement between the respective portions each with substantially curved cross section. Therefore, those portions may be smoothly fitted.

In another example, the cross section of the concave to be formed in the barrel fitting portion (outer barrel fitting portion) 34 of the barrel catch (outer barrel catch) 31, and the cross section of the convex to be formed in the barrel catch fitting portion 24 of the outer barrel 22 may be formed into a U-like shape.

The above-described cross sections may be arbitrarily formed so long as both the fitting portion (outer barrel fitting portion) 34 and the barrel catch fitting portion 24 are brought into the fitted state or released from the fitted state.

What is claimed is:

1. A toy gun comprising:

a toy gun body;

a barrel; and a barrel catch, wherein the toy gun body comprises:

a barrel attachment portion configured to attach the barrel, the barrel attachment portion comprising a barrel catch housing portion for housing the barrel catch, a surface of the barrel catch housing portion having an opening from which a pressing portion as a part of the barrel catch is exposed, wherein the barrel catch comprises:

a barrel through hole with a diameter larger than that of an outer circumference of the barrel, the barrel through hole allowing penetration of the barrel through a center of the barrel through hole; and a barrel fitting portion to which the barrel is fitted and attached on an inner circumference of a hole as an opposite portion of the pressing portion exposed from the opening, the barrel catch being housed in the barrel catch housing portion slidably in a direction defined by the pressing portion and the opposite portion of the pressing portion, wherein the barrel comprises:

a barrel catch fitting portion fittable to the barrel fitting portion of the barrel catch when penetrating the barrel through the barrel catch, and wherein the barrel slidably penetrates the barrel through hole of the barrel catch in the direction defined by the pressing portion and the opposite portion of the pressing portion of the barrel catch.

2. The toy gun according to claim 1, wherein the barrel fitting portion of the barrel catch has a curved convex cross section, and the barrel catch fitting portion of the barrel has a curved concave cross section that is fittable to the convex shape of the barrel fitting portion.

3. The toy gun according to claim 1, wherein the barrel catch slidingly moves, and pressing the pressing portion to the barrel allows to release a fitting state between the barrel catch fitting portion of the barrel and the barrel fitting portion of the barrel catch, and stopping pressing of the pressing portion to the barrel allows fitting between the barrel fitting portion and the barrel catch fitting portion to fix the barrel to the barrel catch.

4. The toy gun according to claim 1, wherein the barrel is an outer barrel.

5. The toy gun according to claim 1, wherein the barrel through hole has a diameter larger than that of the outer circumference of the barrel in the direction defined by the pressing portion and the opposite portion.

6. The toy gun according to claim 1, wherein the barrel attachment portion includes a barrel catch housing portion for housing the barrel catch, having a diameter larger than that of the outer circumference of the barrel catch in the direction defined by the pressing portion and the opposite portion.

7. The toy gun according to claim 1, wherein the barrel catch has flexibility.

* * * * *